United States Patent [19]

Capozzola

[11] Patent Number: 4,858,957

[45] Date of Patent: Aug. 22, 1989

[54] IDENTIFICATION TAG

[76] Inventor: Carl A. Capozzola, 21515 Hawthorne Blvd., Suite 1140, Torrance, Calif. 90503

[21] Appl. No.: 277,351

[22] Filed: Nov. 28, 1988

Related U.S. Application Data

[63] Continuation-in-part of Ser. No. 103,654, Oct. 2, 1987, abandoned.

[51] Int. Cl.[4] ..... B42D 15/00; B44C 5/00; B44C 3/00; B44C 3/02

[52] U.S. Cl. ..... 283/81; 283/75; 156/240; 40/636

[58] Field of Search ..... 283/74, 75, 81; 156/239, 237, 240; 40/2, 3, 14, 330, 625, 306; 36/12, 25 R, 88

[56] References Cited

U.S. PATENT DOCUMENTS

| | | | |
|---|---|---|---|
| 2,985,970 | 5/1961 | McCarthy | 36/88 |
| 3,664,913 | 5/1972 | Ratcliff | 156/240 |
| 3,799,829 | 3/1974 | Heatwolf | 156/240 |
| 4,317,852 | 3/1982 | Ogden | 156/240 |
| 4,430,816 | 2/1984 | Seton et al. | 40/2 R |
| 4,510,006 | 4/1985 | Lawson | 156/240 |

*Primary Examiner*—Douglas D. Watts
*Assistant Examiner*—Paul M. Heyrana
*Attorney, Agent, or Firm*—John E. Halamka

[57] ABSTRACT

A personal identification tag for notation of name, address, medical information, etc. which may be installed inside the shoe of the user. During distribution the paper layer made up of a notational part and a border on the edges of the notational part are attached by an adhesive layer to a clear plastic overlay. The backing of the paper layer is removable from the adhesive layer. During installation, the boarder is removed from the tag and discarded. In another embodiment, the paper layer serves as a backing to a notational strip as well as a overlay portion, both having an adhesive layer. The surface of the notational strip opposite the adhesive layer may have an opaque layer added to accept writing of identification data. For either configuration, the notational part of the tag is positioned in an accessible part of the shoe or other article. The notational part of the tag is protected from wear and moisture and held in place by the clear plastic overlay and the adhesive layer.

3 Claims, 2 Drawing Sheets

Fig. 1.
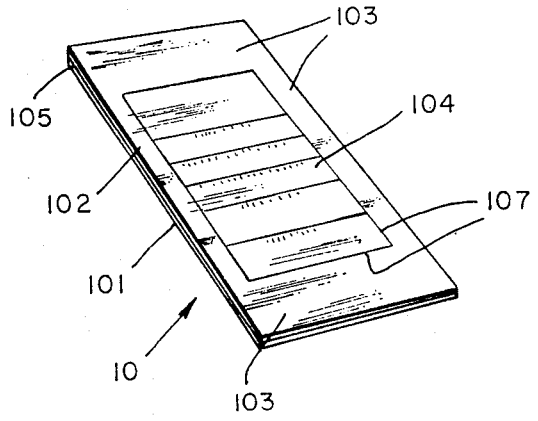
Fig. 2.
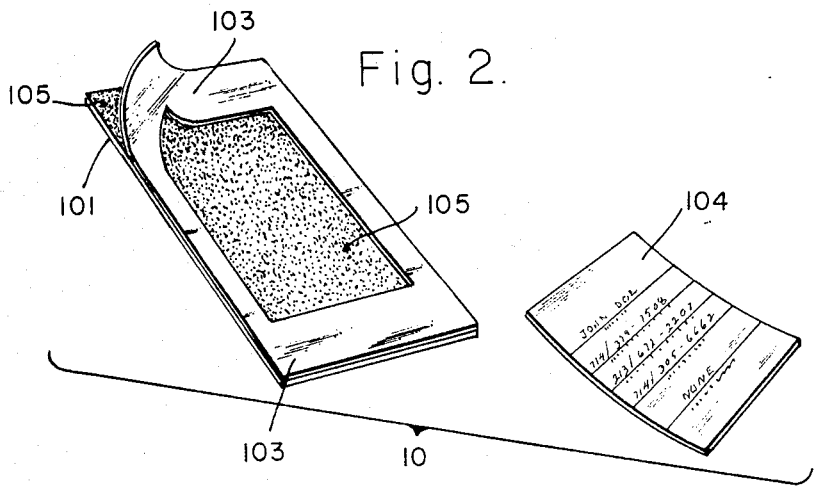
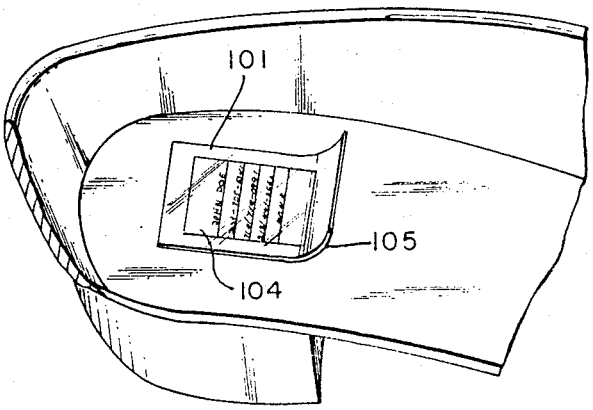
Fig. 3.

IDENTIFICATION TAG

BACKGROUND OF THE INVENTION

Field of the Invention

This invention is a continuation-in-part of U.S. application Ser. No. 07/103,654, filed Oct. 2, 1987 by the same inventor for an identification tag placed inside a shoe, and now abandoned.

DESCRIPTION OF THE PRIOR ART

Identification tags of various designs and configurations are commonly used to identify children and adults with medical problems such as allergies, diabetes, etc.

Environmental and safety considerations have limited what identification tags are acceptable under human engineering considerations.

The attachment of identification tags around the neck or an extremity such as a wrist or ankle have been most prominent. However, the attachment is usually by means of a chain in contact with the skin. The chain and tag must be manufactured of a material which will not corrode. The usual material chosen is silver or gold making this method of identification expensive.

Further, the wearing of chains around the neck, wrist or ankle introduce a safety hazard to the user. The chain can become entangled in clothing and machinery and is a shock hazard in this age of the proliferation of electronic devices. In addition, the chain tag is visible to others and subjects the user to the subtleties of overt of subliminal discrimination against persons with a "medical condition" such as AIDS. Finally, the user may forget to put on a chain type ID.

Some approaches have utilized microdots attached to the dental surface of the user. A special reader not readily available in the field is required to make use of this arrangement.

Some approaches to solve the problems have been to attach identification tags to articles of clothing. One such approach utilizes a strong fiber paper with a hole through which a shoe lace is threaded to attach the paper to the outside of the shoe.

This solves the problem of safety but does not solve the problem of protecting the tag from the wear and tear of the elements and destruction by contamination.

Thus, there has long been a need for an arrangement to identify a person and specify any particular medical needs peculiar to that person.

It is desired that the identification tag be attachable to an accessible part of the person such as clothing rather than around the neck or extremity of the person.

Further, it is desired that the identification tag be protected from wear and contamination.

It is further desired that the identification tag not publicly display confidential information as to the medical condition of the user.

SUMMARY OF THE INVENTION

Accordingly, it is an object of the present invention to provide an improved identification tag attachable inside the shoe of the person to identify the person along with a provision for notation of any medical needs of the person.

It is another object of the present invention to provide an improved identification tag which is protected from wear as well as protected from contamination by moisture.

It is yet another object of the present invention to provide an improved identification tag which is private, worn away from public view yet available to communicate vital medical information should the user be unconscious.

The above and other objects of the present invention are achieved, according to a preferred embodiment thereof, by providing an identification tag with a surface which will accept written or typewritten notation. Protection of the identification tag is a provided by a clear plastic overlay having one adhesively attachable surface. The overlay adhesively adheres to the notation surface of the tag and extends beyond the edge of the tag to form a border surrounding the tag. The overlay protects the notation on the tag and the boarder attaches the tag to a preselected surface.

In the preferred embodiment, the surface of the tag opposite the notation surface is coated to be adhesively removable from the adhesive side of the overlay.

The identification tag and overlay are of a preselected size to accommodate the notation and to fit within the heel portion of a shoe. The placement of the identification tag inside the shoe heel area allows quick access to the notation contained thereon in case of emergency.

The placement of the tag inside the shoe of the user solves the problem of entanglement and shock hazard experienced with chain mounted identification tags.

With the tag containing vital yet confidential medical information inside the shoe, the user's privacy is protected from inadvertent exposure to the public.

Further, the overlay installation of the tag protects the tag from being dislodged from its mounting as experienced by the shoe lace identification tag.

The selection of the shoe as the mounting place for the identification tag is suggested as a shoe is usually worn and is not likely to be forgotten as is the chain identification apparatus.

BRIEF DESCRIPTION OF THE DRAWING

The above and other embodiments of the present invention may be more fully understood from the following detailed description, taken together with the accompanying drawing, wherein similar reference characters refer to similar elements throughout, and in which:

FIG. 1 represents a perspective view of the identification tag arrangement;

FIG. 2 represents a perspective view of the tag removed from the overlay;

FIG. 3 represents a top view of the identification tag arrangement being assembled inside the heel of a shoe;

DESCRIPTION OF A PREFERRED EMBODIMENT

Figure 4:
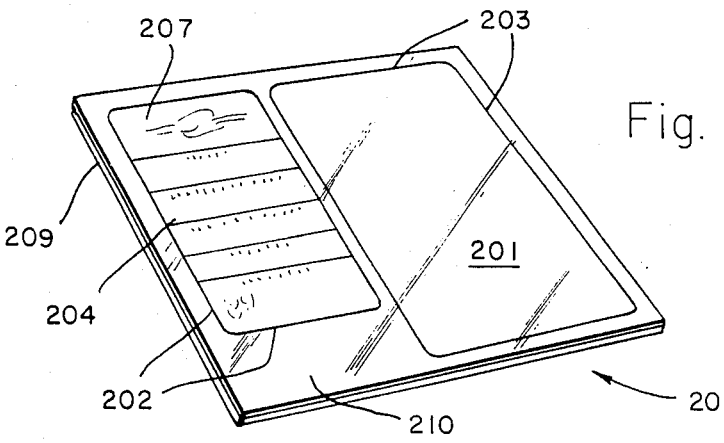
FIG. 4 represents a perspective view of another embodiment of the identification tag arrangement.

Referring now to the drawing, there is illustrated in FIG. 1 a perspective view of the identification tag apparatus 10. The apparatus 10 has two layers of sheet material, an overlay 101 layer and the tag 102 layer.

The overlay 101 is fabricated of a clear plastic sheet material. An adhesive layer is applied to one side of the overlay 101.

The tag 102 is fabricated of paper sheet material. The first side of the paper sheet material is smooth to be adhesively removable from the adhesive layer on the overlay 101. The second side of the paper will accept writing or typing. The tag 102 has a serration 107 a preselected distance from the perimeter of the tag 102. The serration 107 separates the tag 102 into a removable boarder 103 and a notational strip 104. The user may write or type upon the surface of the second side of the notational strip 104.

The removable boarder 103 is a preselected width detachable from the notational strip 104 along the serration 107. The configuration depicted in FIG. 1 shows the removable boarder 103 on the periphery of the identification tag arrangement 10. The removable boarder 103 may be configured along only two or three of the edges of the identification tag arrangement 10. The purpose of the removable border 103 is to cover and protect a portion of the overlay 101 during distribution and preparation for use and to allow the configuration of the notational strip 104 to be smaller than the overlay 101. After removal, the removable border 103 is discarded. The preferred embodiment utilizes the exposed surface of the removable border 103 for instructions for installation of the identification tag arrangement 10.

The user may write or type on the notational strip 104 a name, address, phone number and any pertinent personal medical information such as allergies, or medical conditions such as being a diabetic.

Referring to FIG. 2, the overlay 101 has one surface containing an adhesive layer 105. There is depicted a second surface 106 to the notational strip 104. The second surface 106 is adhesively removable from the adhesive layer 105. The removable border 103 is also adhesively removable from the adhesive layer 105, detachable from the notational strip 104 along the serration 107 and is discarded by the user.

The installation of the identification tag arrangement 10 inside the shoe of the user is depicted in FIG. 3. After removal of the notational strip 104 from the adhesive surface 105 of the overlay 101 as shown in FIG. 2, the user places the notational strip 104 on the inside surface of an accessible portion of the shoe. The overlay 101 is then placed on top of the notational strip 104 with the adhesive layer 105 in contact with the notational strip 104. Because the configuration of the notational strip 104 is smaller than the overlay 101, the overlay 101 can be placed on top of the notational strip 104 creating an adhesive border surrounding the notational strip 104 whereby the notational strip 104 is held in place.

If the user prefers, the user may attach the notational strip 104 to the adhesive layer 105 of the overlay 101 and then place the combination in an accessible portion of a shoe or other article.

The overlay 101 is fabricated of clear plastic and the adhesive layer 105 is preselected to be transparent. The user supplied information on the surface of the notational strip 104 is readable through the overlay 101.

The adhesive boarder surrounding the notational strip 104 protects the notational strip 104 from direct contact with the user's foot, seals the notational strip 104 from the moisture pervasive within the shoe environment and keeps the notational strip 104 in place.

FIG. 4 shows another embodiment of the invention. The identification tag device 20 has two layers of sheet material, a backing sheet 209 and a clear sheet 210. The clear sheet 210 is perforated along line 202 to form the notational strip 204 and along line 203 to form the overlay 201. The dimensions of the overlay 201 are preselected to be larger than the dimensions of the notational strip 204 so that the overlay 201 will completely cover the notational strip 204.

The clear sheet 210 is uniformly covered by an adhesive layer 205 on the side facing the backing sheet 209. The backing sheet 209 is smooth to be adhesively removable from the adhesive layer 205.

Figure 5:
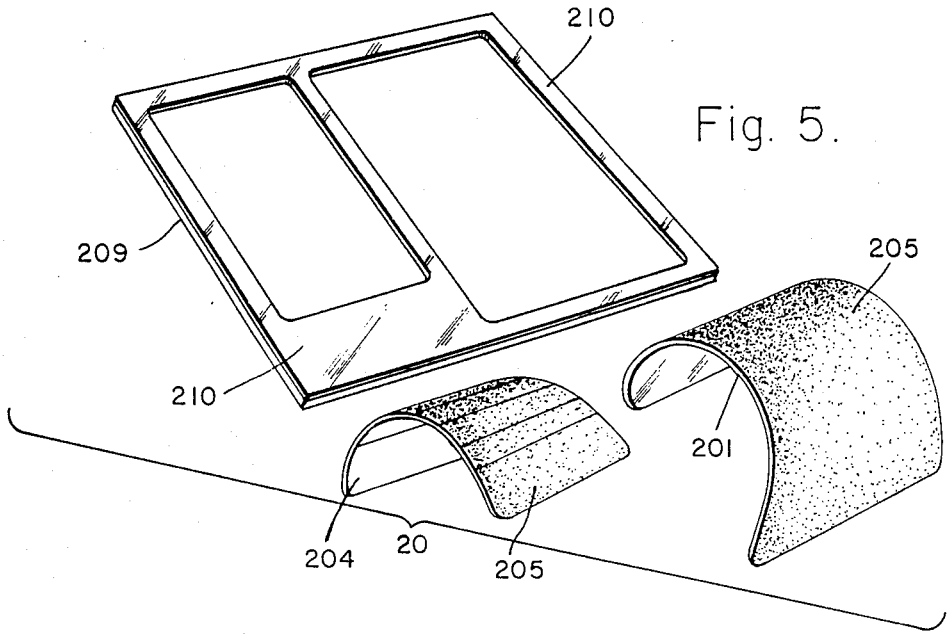
FIG. 5 represents a perspective view of the tag and overlay removed from the backing.

Because the upper surface of the clear sheet 210 may not accept writing by ball point pen or similar instrument without costly treatment to create a rough surface, the side of the notational strip 204 opposite the adhesive layer 205 may be covered with an opaque layer 207, shown in FIG. 5, which readily accepts ball point pen ink.

The notational strip may be imprinted with lines and suggestions for identification information such as name, emergency phone numbers, doctor's phone number, allergies, etc.

Referring to FIG. 5, the overlay 201 with adhesive layer 205 is shown removed from the backing 209 along overlay perforations 203. In a similar manner, after the identification data is entered by the user on the opaque layer 207, the notational 9 strip 204 with the opaque 207 on one side and the adhesive layer 205 on the other side is shown removed from the backing 209 along notational strip perforations 202.

Figure 6:
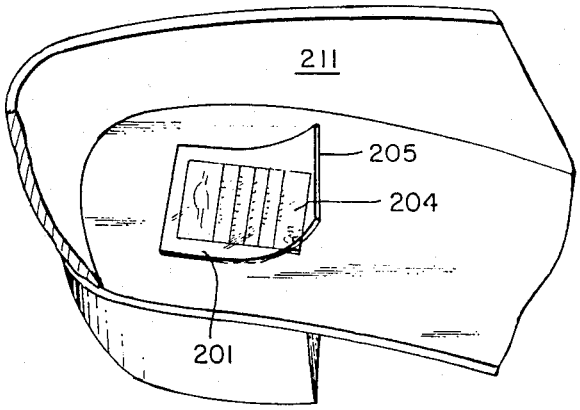
FIG. 6 represents a top view of the embodiment being assembled inside the heel of a shoe.

FIG. 6 shows how the identification tag is assembled on the inside sole of a shoe 211. First the notational strip 204 is positioned and adhesively attached to the sole of the shoe 211. The clear plastic overlay 201 is positioned over the notational strip 204 and adhesively attached to the upper layer of the notational strip 204 and the inside sole of the shoe 211. The overlay 201 protects the user entered identification date written on the upper surface of the notational strip 204. Normal wear, washing, sweat, dirt, etc., do not destroy the identification data written on the notational strip 204.

This concludes the description of a preferred embodiment of the present invention. Those skilled in the art may find many variations and adaptations falling within the scope of this invention, and the appended claims are intended to cover all such variations and adaptations falling within the true scope and spirit of the invention.

What is claimed is:

1. An identification tag arrangement comprising, in combination:

a sheet of clear transparent material;

a transparent adhesive layer applied to one side of said clear sheet material;

a backing sheet having at least one smooth side adhesively removable from said adhesive layer;

a notational strip perforation of said clear sheet material outlining a notational strip;

an overlay perforation of said clear sheet material forming an overlay larger than said notational strip;

under the condition of removal of said notational strip from said backing sheet and removal of said overlay from said backing sheet, the user may place the notational strip in a preselected location with said adhesive layer down and may place said overlay on top of said notational strip with said adhesive layer in contact with said notational strip.

2. The identification tag arrangement defined in claim 1 wherein:

the surface of said notational strip opposite said adhesive layer may accept writing or typing by the user of preselected identification data.

3. The identification tag arrangement defined in claim 1 further comprising:

an opaque layer applied to the side of the notational strip opposite said adhesive layer whereby said opaque layer may accept writing or typing by the user of preselected identification data.

* * * * *